US011040843B2

(12) United States Patent
Takahashi

(10) Patent No.: US 11,040,843 B2
(45) Date of Patent: Jun. 22, 2021

(54) IMAGE FORMING APPARATUS

(71) Applicant: TOSHIBA TEC KABUSHIKI KAISHA, Tokyo (JP)

(72) Inventor: Kazutoshi Takahashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 151 days.

(21) Appl. No.: 16/536,495

(22) Filed: Aug. 9, 2019

(65) Prior Publication Data

US 2021/0039902 A1 Feb. 11, 2021

(51) Int. Cl.

| | |
|---|---|
| ***B65H 5/06*** | (2006.01) |
| ***G03G 15/00*** | (2006.01) |
| ***G03G 21/18*** | (2006.01) |

(52) U.S. Cl.

CPC ..... *B65H 5/06* (2013.01); *G03G 15/6502* (2013.01); *G03G 15/757* (2013.01); *G03G 21/186* (2013.01); *G03G 21/1857* (2013.01); *B65H 2404/1521* (2013.01); *B65H 2404/161* (2013.01); *B65H 2404/166* (2013.01); *G03G 2215/00388* (2013.01); *G03G 2215/00679* (2013.01)

(58) Field of Classification Search

CPC ..... B65H 2404/1521; B65H 2404/161; B65H 2404/166; B65H 5/06; G03G 15/6502; G03G 15/757; G03G 21/1857; G03G 21/186; G03G 2215/00388; G03G 2215/00679

See application file for complete search history.

(56) References Cited

U.S. PATENT DOCUMENTS

2007/0031173 A1* 2/2007 Nishitani ..... B65H 9/002 400/624
2020/0103006 A1* 4/2020 Tomatsu ..... F16H 3/003

FOREIGN PATENT DOCUMENTS

CN 205656430 10/2016
JP 09110204 A * 4/1997

* cited by examiner

*Primary Examiner* — Francis C Gray
(74) *Attorney, Agent, or Firm* — Amin, Turocy & Watson, LLP

(57) ABSTRACT

According to one embodiment, an image forming apparatus includes a process unit, a first rotator, a second rotator, a driving force transmission mechanism, and a displacement mechanism. The process unit forms an image. The first rotator is rotatable about a shaft in a first direction and a second direction reverse to the first direction. The second rotator is disposed in parallel to the first rotator. The second rotator is detachably connected to the process unit. The driving force transmission mechanism transmits a driving force of the first rotator to the second rotator to rotate the second rotator about a shaft when the first rotator is rotated in the first direction. The displacement mechanism releases the connection between the second rotator and the process unit by displacing the second rotator in a shaft direction when the first rotator is rotated in the second direction.

20 Claims, 15 Drawing Sheets

IMAGE FORMING APPARATUS

FIELD

Embodiments described herein relate generally to an image forming apparatus.

BACKGROUND

An image forming apparatus includes a process unit that forms an image and a connection mechanism that transmits a driving force to the process unit. For maintenance or the like, the process unit is detached from the image forming apparatus. Therefore, the connection mechanism is configured to be detachably mounted on the process unit.

However, in the image forming apparatus, the structure of the connection mechanism is complex and is not easy to miniaturize.

DETAILED DESCRIPTION

Figure 1:
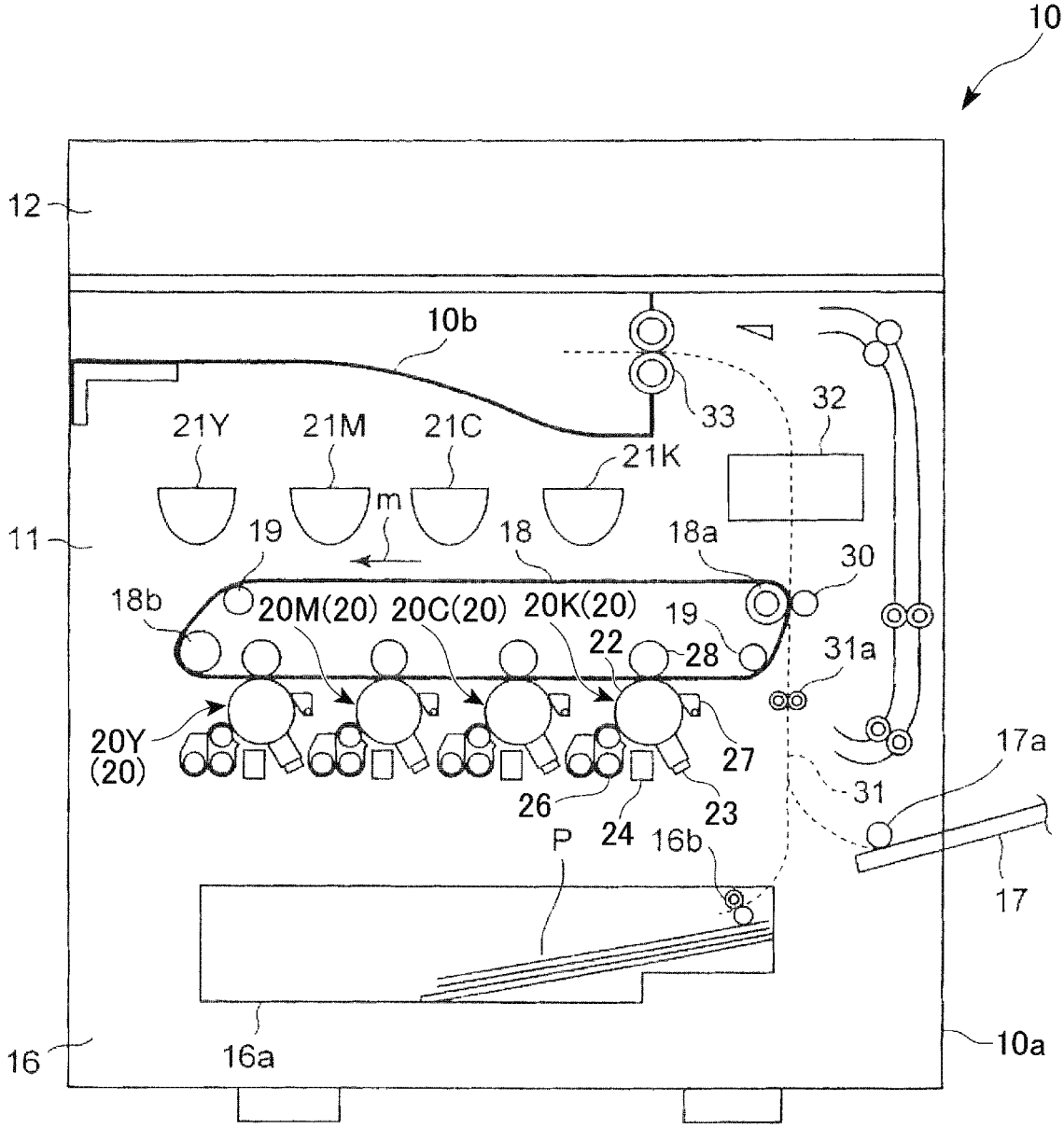
FIG. 1 is a diagram illustrating a configuration of an image forming apparatus according to a first embodiment.

In general, according to one embodiment, an image forming apparatus includes a process unit, a first rotator, a second rotator, a driving force transmission mechanism, and a displacement mechanism. The process unit forms an image. The first rotator is rotatable about a shaft in a first direction and a second direction reverse to the first direction.

The second rotator is disposed in parallel to the first rotator. The second rotator is detachably connected to the process unit. The driving force transmission mechanism transmits a driving force of the first rotator to the second rotator to rotate the second rotator about a shaft when the first rotator is rotated in the first direction. The displacement mechanism releases the connection between the second rotator and the process unit by displacing the second rotator in a shaft direction when the first rotator is rotated in the second direction.

Hereinafter, an image forming apparatus according to an embodiment will be described with reference to the drawings. In each drawing, the same reference numerals are given to the same constituents. In each drawing, dimensions and a shape of each member are exaggerated or simplified for easy visibility.

First Embodiment

An image forming apparatus according to a first embodiment will be described.

As illustrated in FIG. 1, an image forming apparatus 10 according to the first embodiment includes a printer unit 11 which is an image forming unit. The printer unit 11 includes four process units 20. The four process units 20 are process units 20Y, 20M, 20C, and 20K using Y (yellow) toner, M (magenta) toner, C (cyan) toner, and K (black) toner. The process units 20Y, 20M, 20C, and 20K are disposed in parallel along an intermediate transfer belt 18.

The process unit 20 includes a photosensitive drum (photoreceptor) 22, an electrostatic charger (charging device) 23, an exposure scanning head (optical device) 24, a development device 26, and a photoreceptor cleaner 27.

The photosensitive drum 22, a photosensitive layer is coated on the surface of a conductive supporter with a cylindrical shape. The electrostatic charger 23 applies charges to the photosensitive drum 22 to charge the surface of the photosensitive drum 22. The exposure scanning head 24 radiates light to the photosensitive drum 22 to form an exposure latent image. The development devices 26 of the process units 20Y, 20M, 20C, and 20K respectively have two-component developer including the Y (yellow) toner, M (magenta) toner, C (cyan) toner, and K (black) toner and carriers. The development device 26 develops the exposure latent image in accordance with the developer. The photoreceptor cleaner 27 removes the toner remaining on the photosensitive drum 22.

The printer unit 11 includes a backup roller 18*a*, a driven roller 18*b*, a tension roller (not illustrated), the intermediate transfer belt 18, a plurality of primary transfer rollers 28, and a secondary transfer roller 30. The backup roller 18*a*, the driven roller 18*b*, and the tension roller (not illustrated) support the intermediate transfer belt 18. The intermediate transfer belt 18 rotates in an arrow m direction. The primary transfer rollers 28 are provided at positions facing the photosensitive drums 22 with the intermediate transfer belt 18 interposed therebetween. The secondary transfer roller 30 is provided at a position facing the backup roller 18*a* with the intermediate transfer belt 18 interposed therebetween.

A paper feed unit (not illustrated) that supplies a sheet is provided below the printer unit 11. The printer unit 11 includes a resist roller 31*a*, a fixing device 32, and a pair of paper discharge rollers 33. The resist roller 31*a*, the secondary transfer roller 30, the fixing device 32, and the pair of paper discharge rollers 33 are provided along a transport path along which the sheet is transported.

The primary transfer roller 28 primarily transfers toner images formed on the photosensitive drums 22 to the intermediate transfer belt 18. The primary transfer rollers 28 of the process units 20Y, 20M, 20C, and 20K form Y (yellow), M (magenta), C (cyan), and K (black) toner images on the intermediate transfer belt 18 so that the toner images overlap to form a color toner image.

The secondary transfer roller 30 is driven and rotated by the intermediate transfer belt 18. The secondary transfer roller 30 secondarily transfers the color toner image on the intermediate transfer belt 18 on the supplied sheet.

Figure 2:
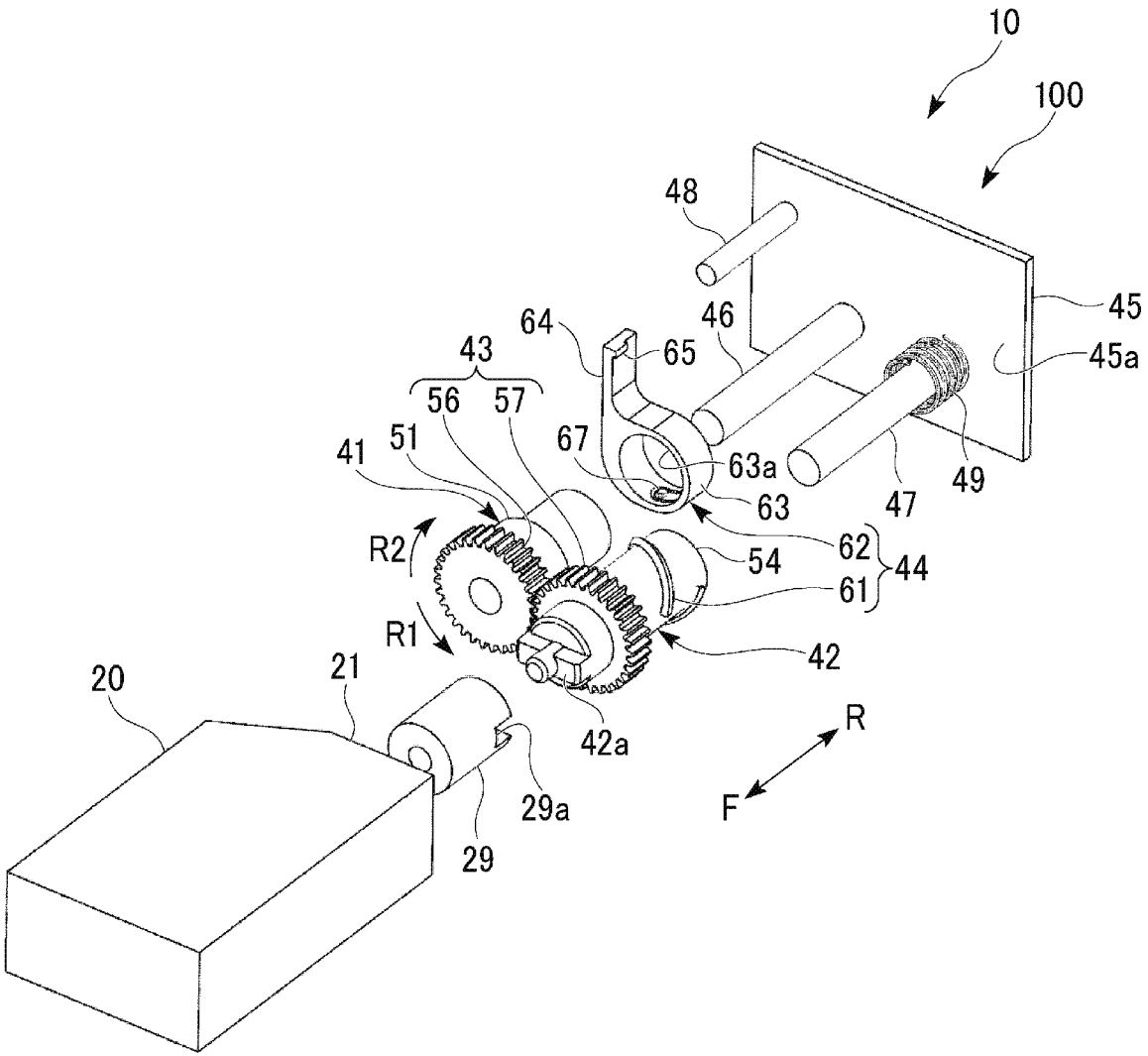
FIG. 2 is an exploded perspective view illustrating a connection mechanism of the image forming apparatus.

As illustrated in FIG. 2, the image forming apparatus includes a connection mechanism 100. The connection mechanism 100 includes a first rotator 41, a second rotator 42, a driving force transmission mechanism 43, a displacement mechanism 44, a base substrate 45, a first shaft 46, a second shaft 47, a stopper 48, and a spring 49 (an urging member).

The first shaft 46 vertically protrudes from a main surface 45*a* of the base substrate 45 on the main surface 45*a*. The first shaft 46 is inserted through the first rotator 41. The second shaft 47 protrudes from a main surface 45*a* of the base substrate 45 to be orthogonal to the main surface 45*a*. The second shaft 47 is inserted through the second rotator 42. The second shaft 47 is formed to be away from the first shaft 46 in a diameter direction. The second shaft 47 is formed in parallel to the first shaft 46.

Hereinafter, a protrusion direction of the first shaft 46 and the second shaft 47 is provisionally referred to as a "front F". A reverse direction to the "front" is provisionally referred to as a "rear R".

The first rotator 41 includes a first cylinder portion 51. The first cylinder portion 51 includes a cylindrical main portion 52 and a cylindrical small-diameter portion 53 (see FIG. 3). The outer diameter of the small-diameter portion 53 is less than the outer diameter of the main portion 52. The small-diameter portion 53 extends from the rear end of the main portion 52 backwards. The first rotator 41 is mounted in the first shaft 46. The first rotator 41 can rotate about a shaft using the first rotator 46 as a central shaft. Specifically, the first rotator 41 can rotate in a first direction R1 which is a shaft circumference direction and a second direction R2 which is a reverse shaft circumference direction to the first direction R1.

A flat portion (not illustrated) with which a contact protrusion 68 (to be described below) of an elastic piece 67 comes into contact may be formed on the outer circumferential surface of the small-diameter portion 53. For example, the flat portion is a part of the outer circumferential surface of the small-diameter portion 53 and is a flat portion vertical to the diameter direction of the small-diameter portion 53.

The second rotator 42 includes a second cylinder portion 54 with cylindrical shape. The second rotator 42 is mounted in the second shaft 47. The second rotator 42 can rotate about a shaft using the second rotator 47 as a central shaft. The second rotator 42 can move in the shaft direction (the central shaft direction of the second rotator 42).

A fitting protrusion 42*a* that fits in a fitting concave 29*a* (fitting reception portion) of a coupling 29 of the process unit 20 is formed at the distal end of the second rotator 42. The fitting protrusion 42*a* is formed to protrude on a distal end surface of the second rotator 42 forwards. The fitting protrusion 42*a* is formed in the diameter direction of the second rotator 42. The fitting protrusion 42*a* can transmit a rotational driving force of the second rotator 42 to the coupling 29 when the fitting protrusion 42*a* fits in the fitting concave 29*a*.

A structure in which the process unit and the second rotator are connected (connection structure) is not particularly limited to the structure illustrated in FIG. 2. For example, the connection structure may be the following configuration. The coupling of the process unit includes a fitting protrusion (fitting reception portion). The second rotator includes a fitting concave (fitting portion). The fitting protrusion of the process unit can be fitted in the fitting concave of the second rotator. The process unit and the second rotator are connected when the fitting protrusion fits in the fitting concave.

The driving force transmission mechanism 43 includes a first gear 56 and a second gear 57. The first gear 56 is formed on the outer circumferential surface of the main portion 52 of the first rotator 41. The first gear 56 is integrated with the first cylinder portion 51.

The second gear 57 is formed on the outer circumferential surface of the second cylinder portion 54. The second gear 57 is integrated with the second cylinder portion 54. The first gear 56 and the second gear 57 can transmit a driving force of the first rotator 41 to the second rotator 42 in the mutual engagement state to rotate the second rotator 42 about the shaft.

The displacement mechanism 44 includes a slope portion 61 and an engagement portion 62.

The slope portion 61 is formed on the outer circumferential surface of the second cylinder portion 54 of the second rotator 42. The slope portion 61 is a convex portion formed in a helical shape about the central shaft of the second rotator 42. The slope portion 61 protrudes outwards in the diameter direction of the second cylinder portion 54 from the outer circumferential surface of the second cylinder portion 54. The slope portion 61 extends in a direction sloped in the shaft direction of the second rotator 42.

Figure 3:
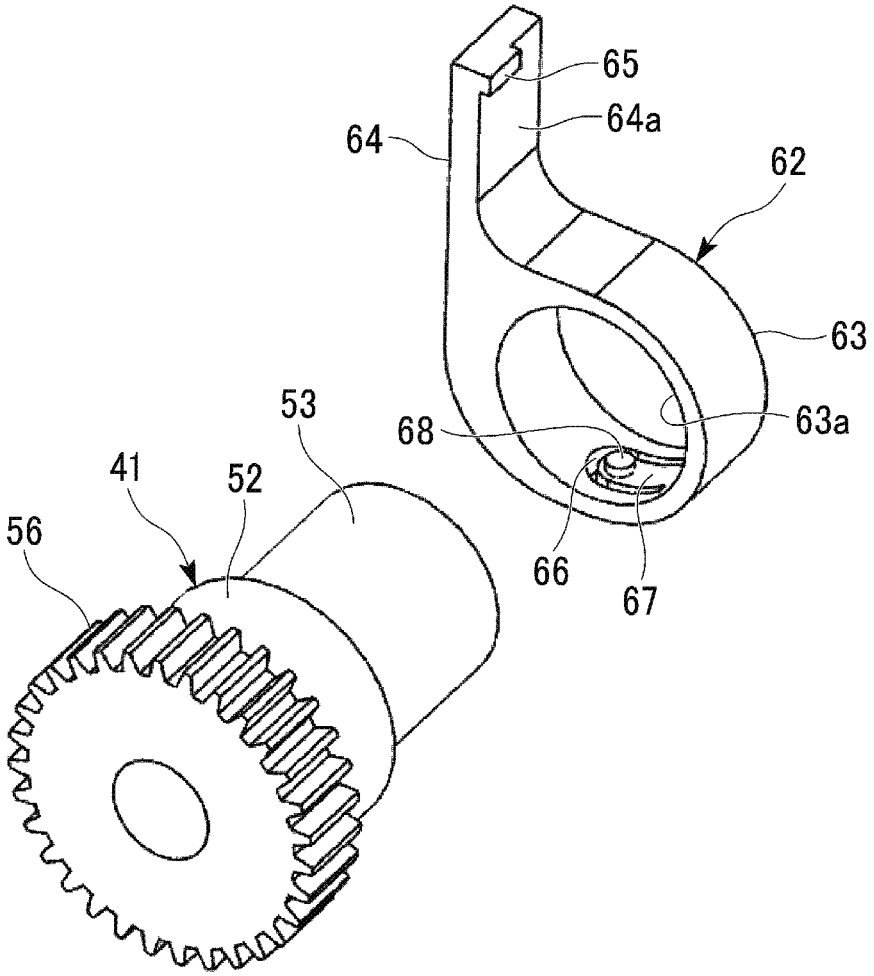
FIG. 3 is a perspective view illustrating a first rotator and an engagement portion of the image forming apparatus.

As illustrated in FIG. 3, the engagement portion 62 includes a base portion 63, an arm portion 64, and an engagement protrusion 65. The base portion 63 is formed in a cylindrical shape. The small-diameter portion 53 of the first cylinder portion 51 is inserted through an insertion hole 63*a* of the base portion 63. An inner diameter of the insertion hole 63*a* is almost equal to the outer diameter of the small-diameter portion 53 or is greater than the outer diameter of the small-diameter portion 53.

In the base portion 63, an incision depth 66 with a U shape is formed. In the base portion 63, the elastic piece 67 with a tongue shape is formed at the incision depth 66. The elastic piece 67 extends in the circumferential direction of the base portion 63. The contact protrusion 68 is formed on the inner circumferential surface of the elastic piece 67. The contact protrusion 68 protrudes inwards in the diameter direction of the base portion 63 from the inner circumferential surface of the elastic piece 67. For example, the contact protrusion 68 has a columnar shape. The central shaft direction of the columnar contact protrusion 68 is parallel to the diameter direction of the base portion 63. The contact protrusion 68 is formed at a position close to the tip end of the elastic piece 67 in the extension direction. The shape of the contact protrusion is not limited to the columnar shape. The shape of the engagement protrusion may be a rectangular parallelepiped shape, a hemisphere shape, a polygonal pyramid shape, or the like.

The contact protrusion 68 comes into contact with the outer circumferential surface of the first rotator 41 in a pressed state by a bending elastic force of the elastic piece 67. When the contact protrusion 68 comes into contact with the outer circumferential surface of the first rotator 41, the engagement portion 62 easily rotates integrally with the first rotator 41 by friction between the contact protrusion 68 and the first rotator 41. When the contact protrusion 68 comes into contact with a flat portion (not illustrated) of the outer circumferential surface of the small-diameter portion 53, relative displacement of the engagement portion 62 to the first rotator 41 in the rotational direction rarely occurs.

The arm portion 64 extends to the outside side of the base portion 63 when the base portion 63 serves as a starting point. The arm portion 64 extends in a tangential direction of the cylindrical base portion 63. The arm portion 64 is formed in a rectangular flat shape. The arm portion 64 is formed in a flat shape parallel to the central shaft direction of the base portion 63.

The engagement protrusion 65 is formed on one surface 64*a* of the arm portion 64. The engagement protrusion 65 is a convex portion that protrudes from the surface 64*a* of the arm portion 64 to be vertical to the surface 64*a*. For example, the engagement protrusion 65 is formed in a rectangular parallelepiped shape.

The shape of the engagement protrusion is not limited to the rectangular parallelepiped shape. The shape of the rectangular parallelepiped shape may be a columnar shape, a hemisphere shape, a polygonal pyramid shape, or the like.

As illustrated in FIG. 1, for example, the spring 49 is a coil spring. The spring 49 urges the second rotator 42 toward the process unit 20 with a reactive force on the main surface 45*a* of the base substrate 45.

Next, an operation of the image forming apparatus 10 will be described.

First, an operation in normal working of the image forming apparatus 10 will be described.

The coupling 29 illustrated in FIG. 2 is contained in the process unit 20. The fitting concave 29*a* of the coupling 29 is exposed to a connection surface 21 (see FIG. 8).

Figure 4:
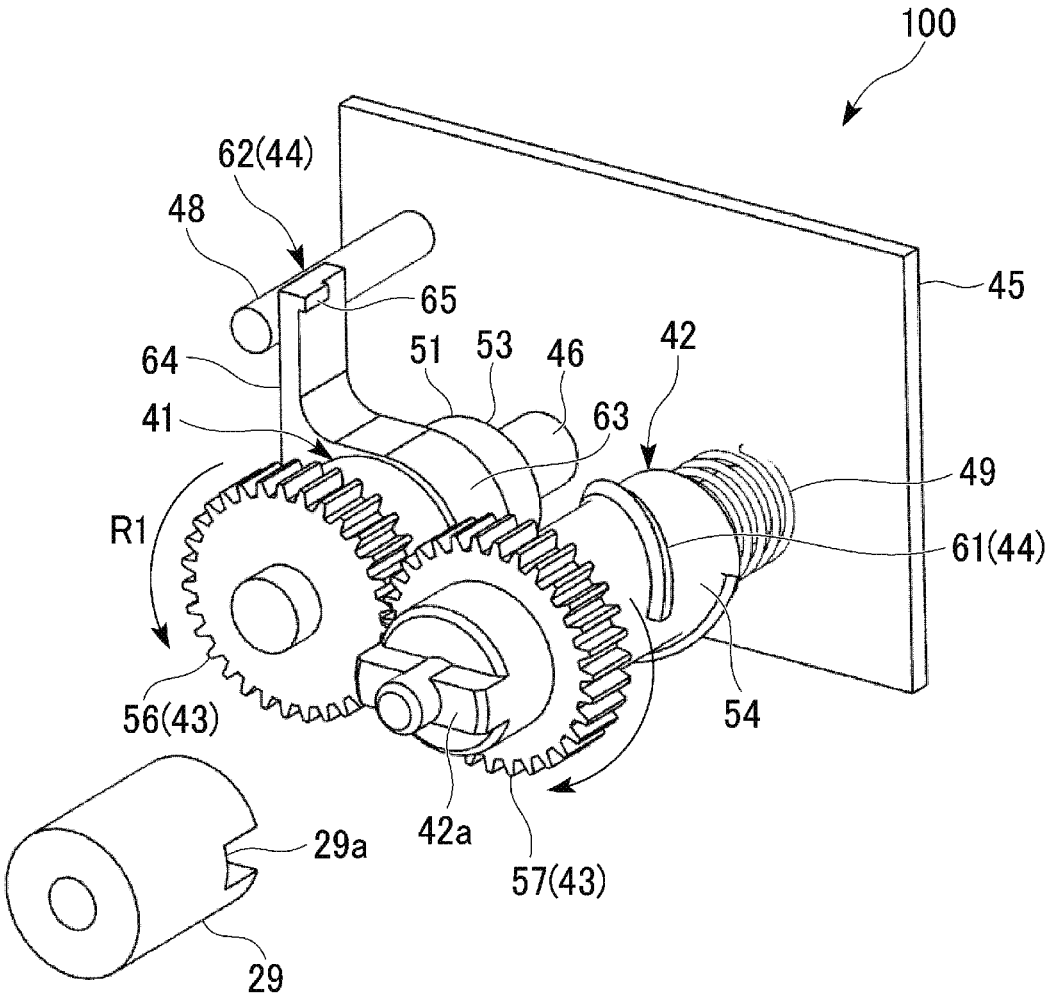
FIG. 4 is a perspective view illustrating the connection mechanism of the image forming apparatus.

As illustrated in FIG. 4, the first rotator 41 is rotated in the first direction R1 by a driving source (not illustrated). At this time, the engagement portion 62 can be rotated in the first direction R1 along with the first rotator 41. The rotation of the engagement portion 62 in the first direction R1 is regulated when the arm portion 64 comes into contact with the stopper 48.

The driving force of the first rotator 41 in the first direction R1 is transmitted to the second rotator 42 by the driving force transmission mechanism 43 (the first gear 56 and the second gear 57). Therefore, the second rotator 42 is driven by the first rotator 41 to be rotated in an arrow direction.

When the fitting protrusion 42*a* of the second rotator 42 fits in the fitting concave 29*a* of the coupling 29 (which is not illustrated), a rotational driving force of the second rotator 42 is transmitted to the coupling 29. A position of the second rotator 42 connected to the coupling 29 is referred to as a "connection position".

Next, an operation when the process unit 20 is detached for maintenance or the like will be described.

Figure 5:
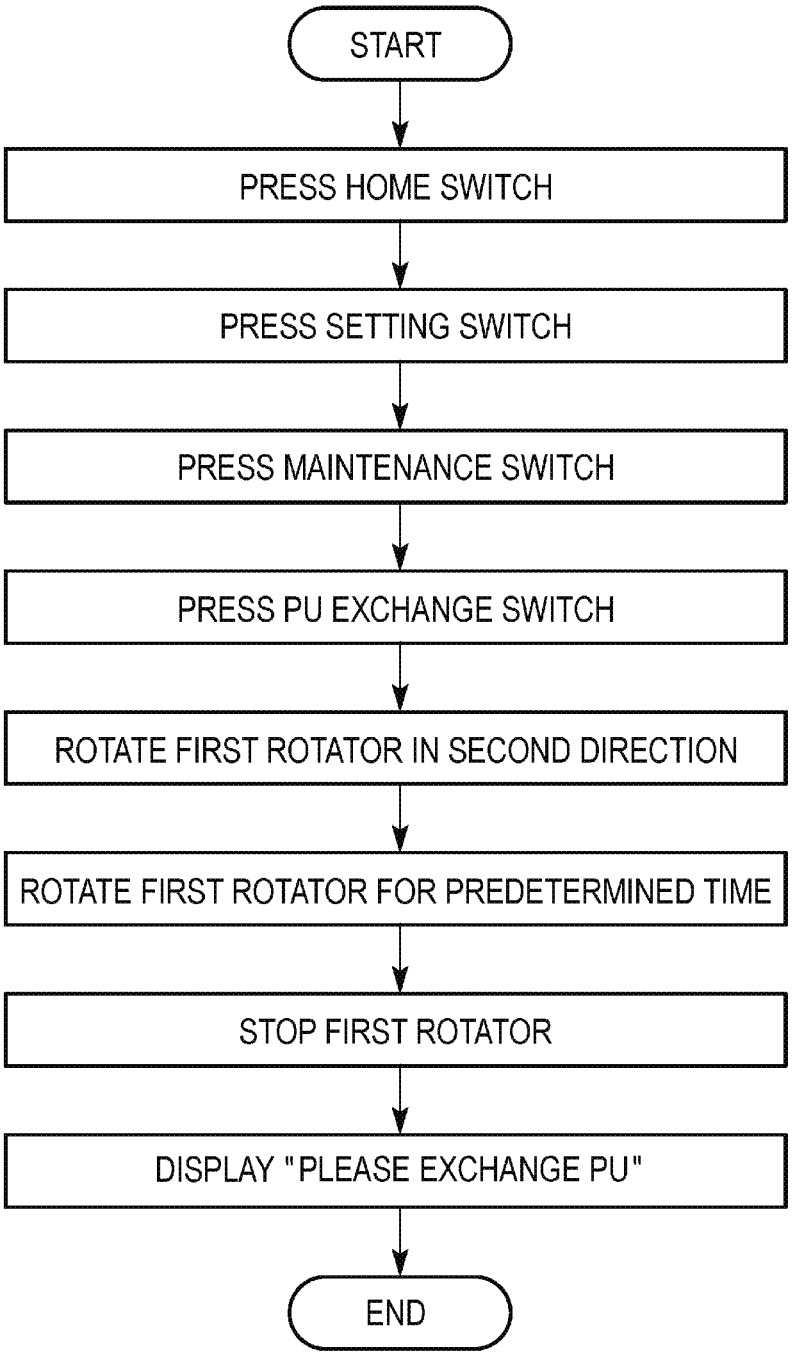
FIG. 5 is a flowchart illustrating an operation of the image forming apparatus.

As illustrated in FIG. 5, a home switch, a setting switch, a maintenance switch, and a process unit (PU) exchange switch on a control panel (not illustrated) are pressed in sequence.

Figure 6:
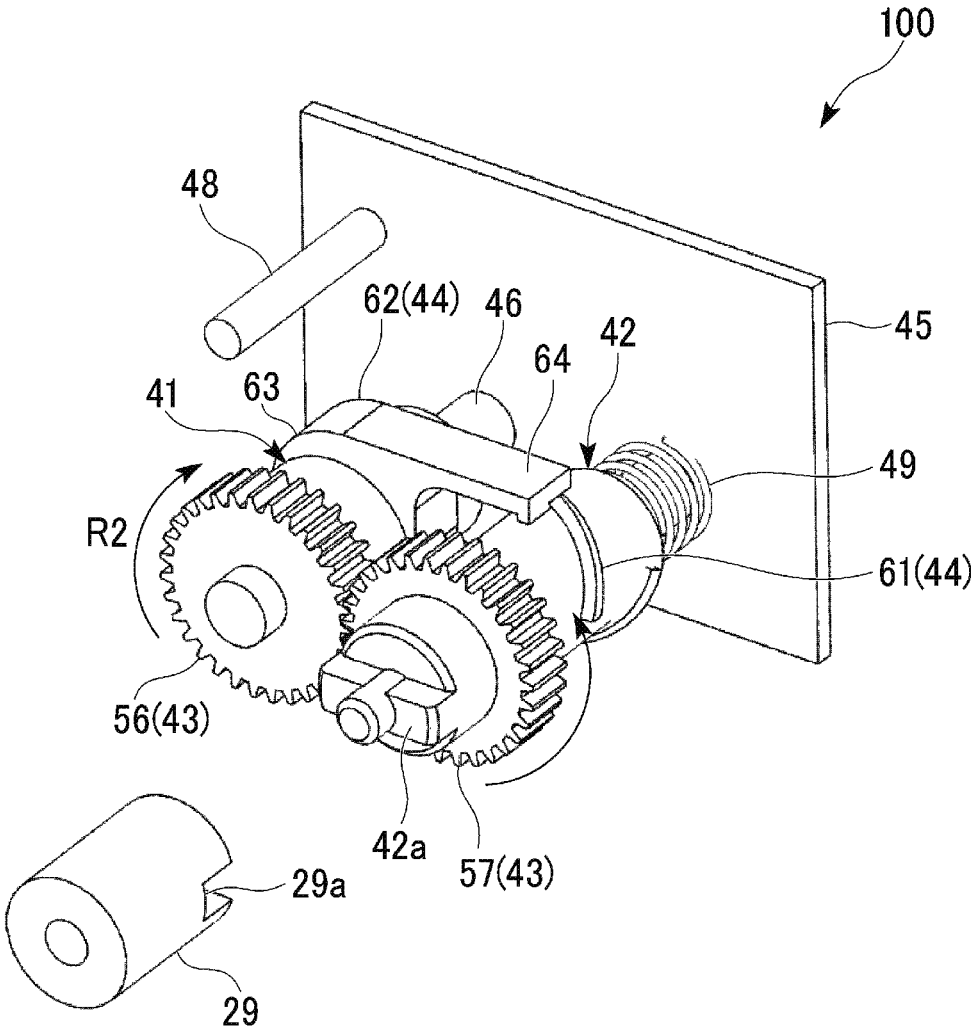
FIG. 6 is a perspective view illustrating the connection mechanism of the image forming apparatus.

Thus, as illustrated in FIG. 6, the first rotator 41 is rotated in the second direction R2 by a driving source (not illustrated). That is, the first rotator 41 is rotated in the reverse direction to that of the normal working. The engagement portion 62 is rotated in the second direction R2 along with the first rotator 41. Thus, the arm portion 64 becomes closes to the second rotator 42. The engagement protrusion 65 can engage with the slope portion 61.

The driving force of the first rotator 41 in the second direction R2 is transmitted to the second rotator 42 by the first gear 56 and the second gear 57. Therefore, the second rotator 42 is driven by the first rotator 41 to be rotated in the arrow direction.

Figure 7:
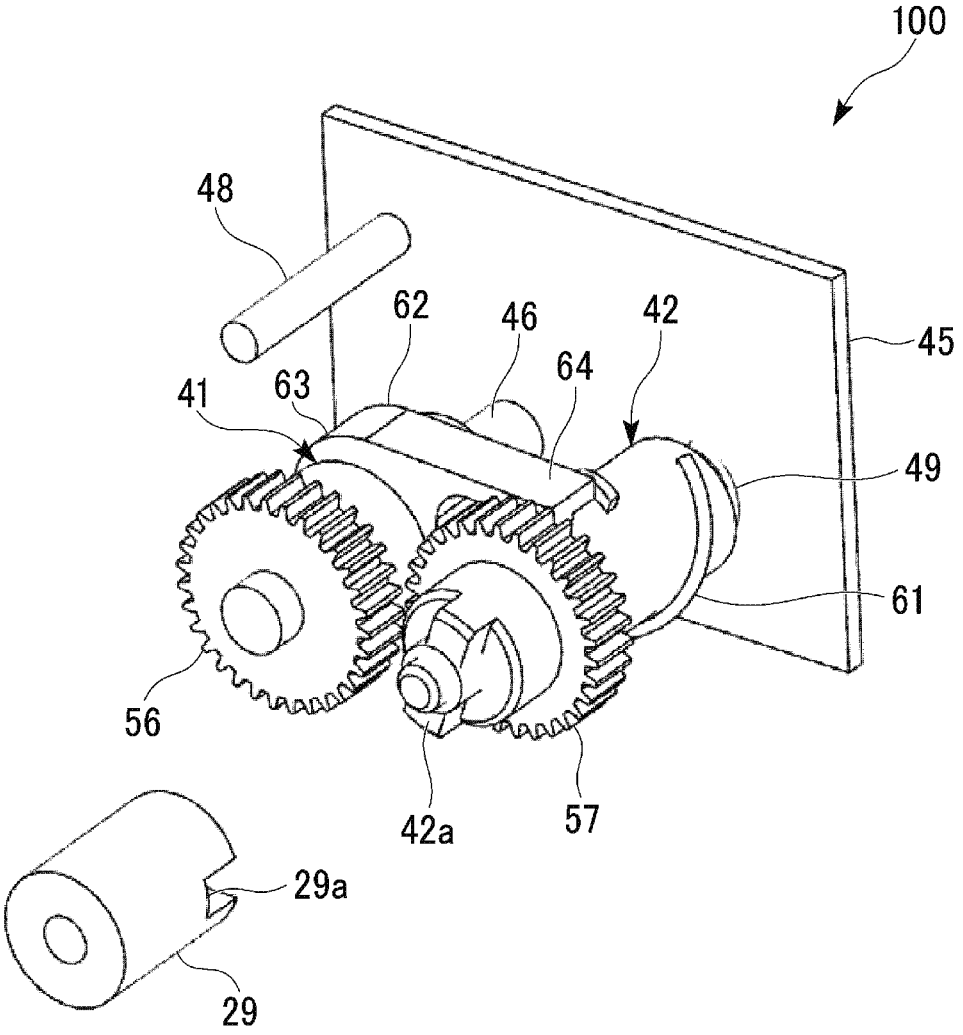
FIG. 7 is a perspective view illustrating the connection mechanism of the image forming apparatus.

When the engagement protrusion 65 engages with the slope portion 61 and the second rotator 42 is rotated in the arrow direction for a predetermined time (see FIG. 5), as illustrated in FIG. 7, the second rotator 42 is displaced in the shaft direction of the second rotator 42 in a direction (backwards) away from the process unit 20 (see FIG. 2) along the slope of the slope portion 61. Thus, the second rotator 42 is dislocated from the coupling 29. When the second gear 57 is dislocated from the first gear 56, the second rotator 42 losses the driving force and thus stops.

The position of the second rotator 42 dislocated from the coupling 29 is referred to as a "connection release position".

After the second rotator 42 is dislocated from the coupling 29, the rotation of the first rotator 41 is stopped. The process unit (PU) which is in an exchange state is displayed on the control panel (not illustrated) (see FIG. 5).

Since the second rotator 42 is dislocated from the coupling 29, the process unit 20 is detached from the image forming apparatus 10 to be supplied for maintenance.

Next, an operation when the process unit 20 is mounted in the image forming apparatus 10 after end of the maintenance will be described.

Figure 8:
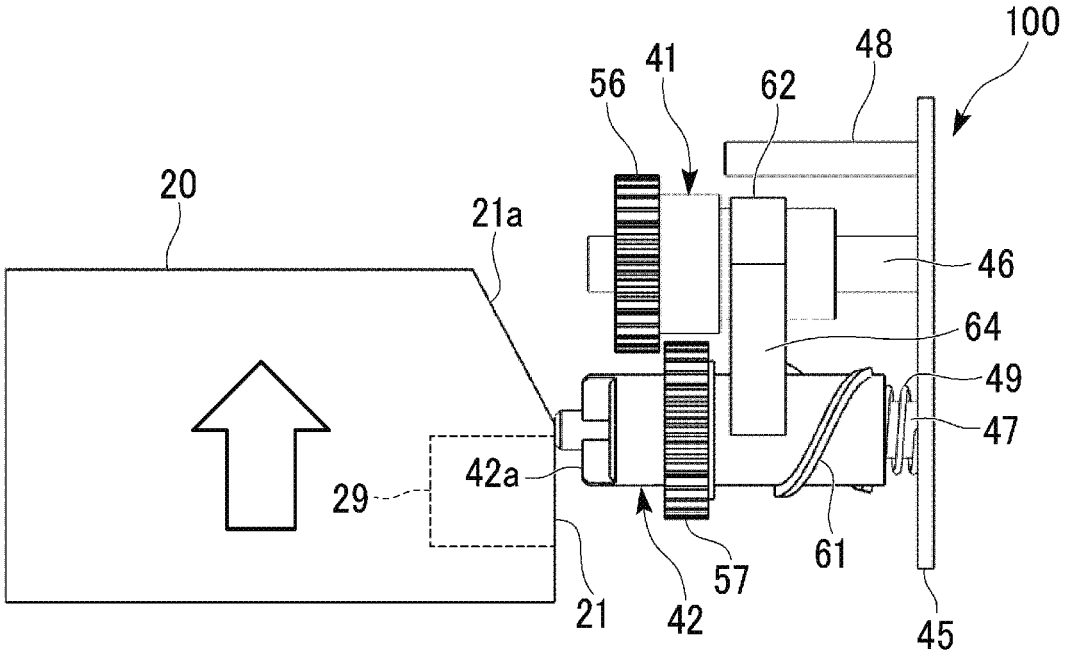
FIG. 8 is a plan view illustrating the connection mechanism of the image forming apparatus.

As illustrated in FIG. 8, a slope portion 21*a* is formed on the connection surface 21 of the process unit 20.

First, a normal operation when the process unit is mounted will be described.

As illustrated in FIG. 8, the process unit 20 is advanced in a mounting direction (see an arrow). Normally, the second rotator 42 is at the connection release position (evacuated position).

Figure 9:
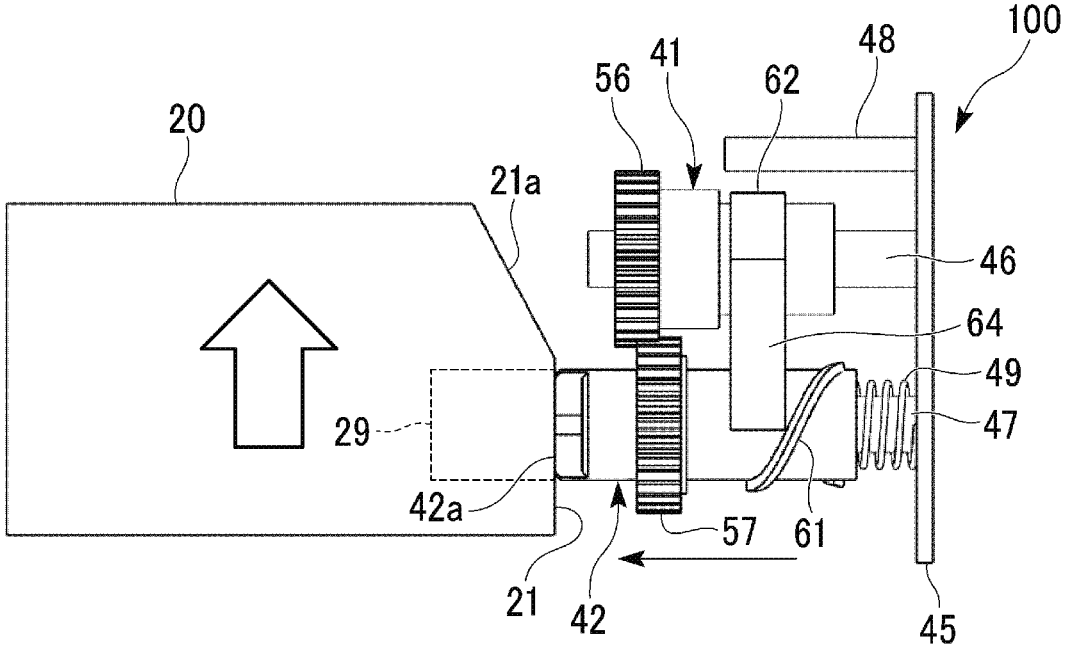
FIG. 9 is a plan view illustrating the connection mechanism of the image forming apparatus.
Figure 10:
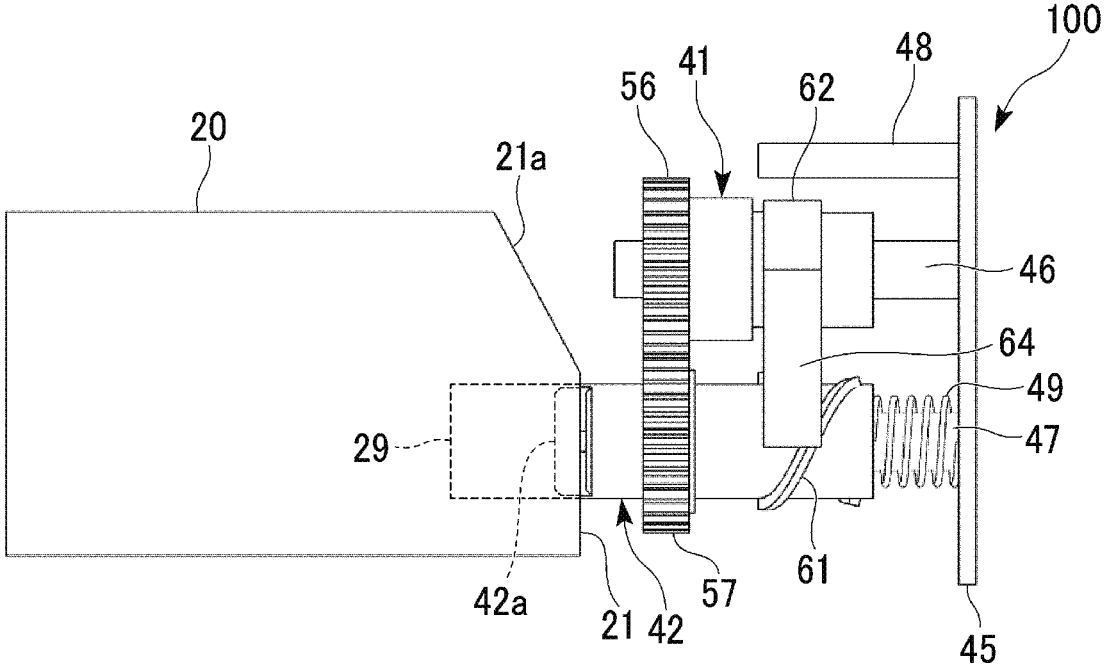
FIG. 10 is a plan view illustrating the connection mechanism of the image forming apparatus.

As illustrated in FIGS. 9 and 10, when the coupling 29 reaches a position corresponding to the second rotator 42, the second rotator 42 is advanced by the urging force of the spring 49 and the fitting protrusion 42*a* fits in the fitting concave 29*a* (see FIG. 7).

Next, an operation when the second rotator is advanced and the process unit is mounted will be described.

Figure 11:
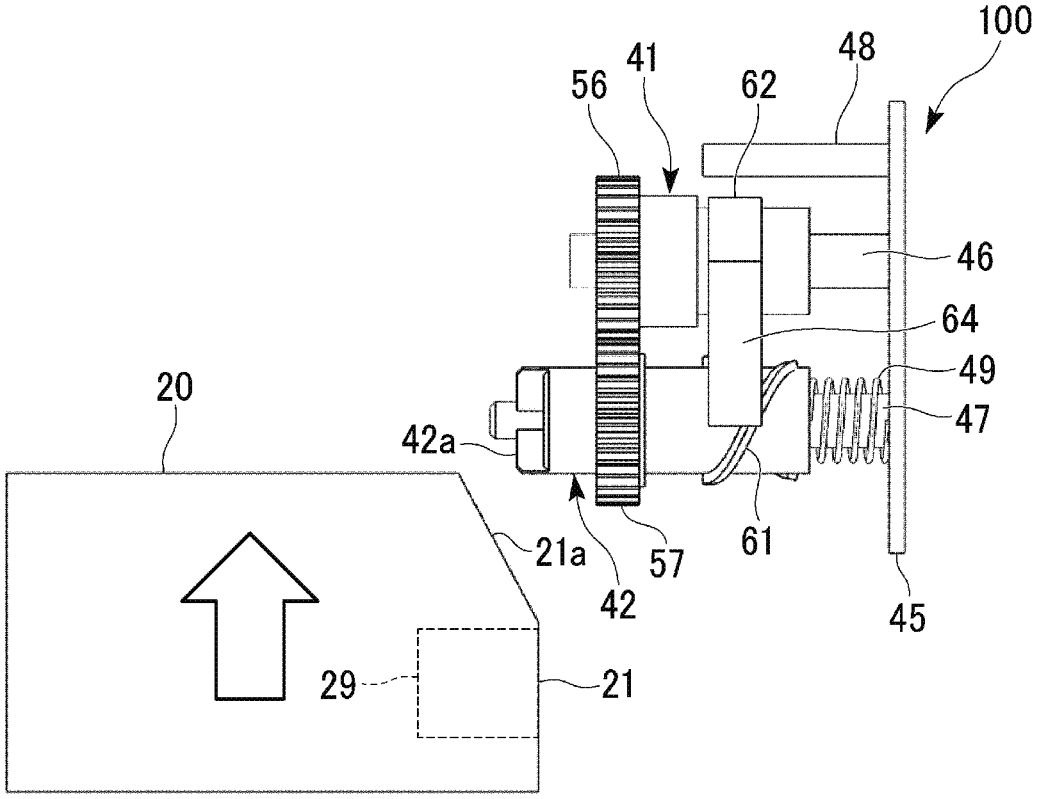
FIG. 11 is a plan view illustrating the connection mechanism of the image forming apparatus.

As illustrated in FIG. 11, the connection mechanism 100 operates as the follows when the second rotator 42 is at the advanced position. The process unit 20 is advanced in the mounting direction (see an arrow).

Figure 12:
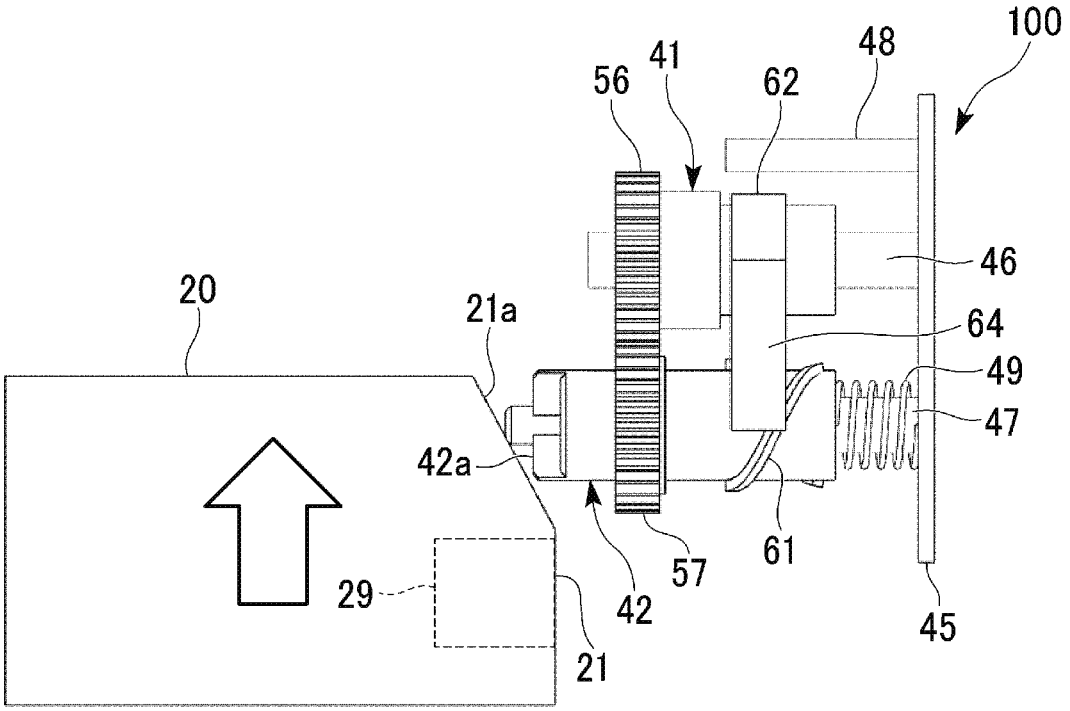
FIG. 12 is a plan view illustrating the connection mechanism of the image forming apparatus.
Figure 13:
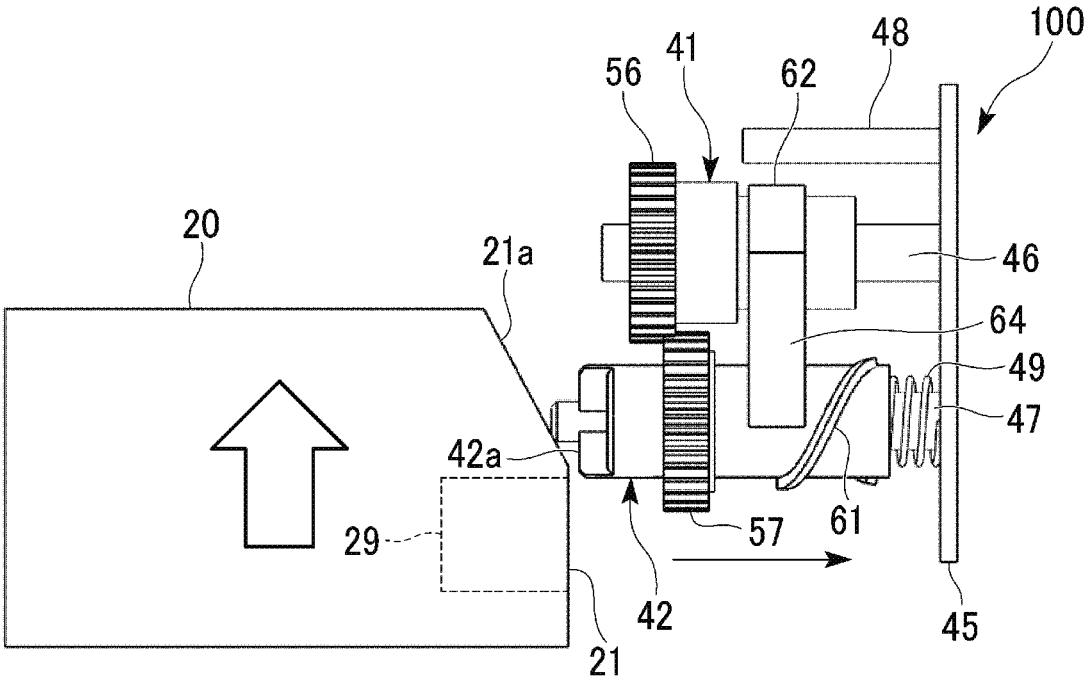
FIG. 13 is a plan view illustrating the connection mechanism of the image forming apparatus.

As illustrated in FIGS. 12 and 13, the distal end of the second rotator 42 comes into contact with the slope portion 21*a* of the process unit 20 to retreat along the slope of the slope portion 21*a*.

As illustrated in FIGS. 9 and 10, when the coupling 29 reaches the position corresponding to the second rotator 42, the second rotator 42 is advanced by the urging force of the spring 49 and the fitting protrusion 42*a* fits in the fitting concave 29*a* (see FIG. 7).

As illustrated in FIG. 6, the image forming apparatus 10 includes the connection mechanism 100 that includes the displacement mechanism 44. The displacement mechanism 44 displaces the second rotator 42 in a shaft direction away from the process unit 20 when the first rotator 41 is rotated in the second direction R2 (the reverse direction to that in the normal working). Thus, the connection between the second rotator 42 and the process unit 20 is released. The image forming apparatus 10 can be miniaturized since the connection between the second rotator 42 and the process unit 20 is released by the connection mechanism 100 with a simple configuration.

The displacement mechanism 44 can displace the second rotator 42 along the slope of the slope portion 61 in the direction away from the process unit 20 by rotating the first rotator 41 in the second direction R2. Since the displacement mechanism 44 displaces the second rotator 42 using the slope portion 61, the structure of the connection mechanism 100 can be simplified.

Since the slope portion 61 is formed in the helical direction about the shaft of the second rotator 42, the second rotator 42 can be displaced in the direction away from the process unit 20 in a broad range in the rotational direction.

The engagement portion 62 includes the base portion 63, the arm portion 64, and the engagement protrusion 65. The engagement portion 62 does not engage with the second rotator 42 when the first rotator 41 is rotated in the first direction R1. The engagement portion 62 engages with the slope portion 61 of the second rotator 42 when the first rotator 41 is rotated in the second direction R2. Accordingly, even in the simple structure, the second rotator 42 can be displaced in the direction away from the process unit 20 only when the first rotator 41 is rotated in the second direction R2.

When the first rotator 41 is rotated in the second direction R2, the engagement portion 62 is rotated in a direction in which the engagement protrusion 65 approaches the second rotator 42 along with the first rotator 41. Therefore, even in the simple structure, the second rotator 42 can be displaced in the direction away from the process unit 20 only when the first rotator 41 is rotated in the second direction R2.

The engagement portion 62 includes the elastic piece 67 that comes into contact with the outer circumferential surface of the first rotator 41. Therefore, the engagement portion 62 is easily rotated integrally with the first rotator 41 by friction with the first rotator 41. Therefore, it is possible to reliably operate the engagement portion 62.

Since the connection mechanism 100 includes the spring 49, the second rotator 42 is pressed toward the process unit 20 to be connectable to the coupling 29.

An engagement portion which is a modification example of the engagement portion 62 illustrated in FIG. 3 will be described.

Figure 14:
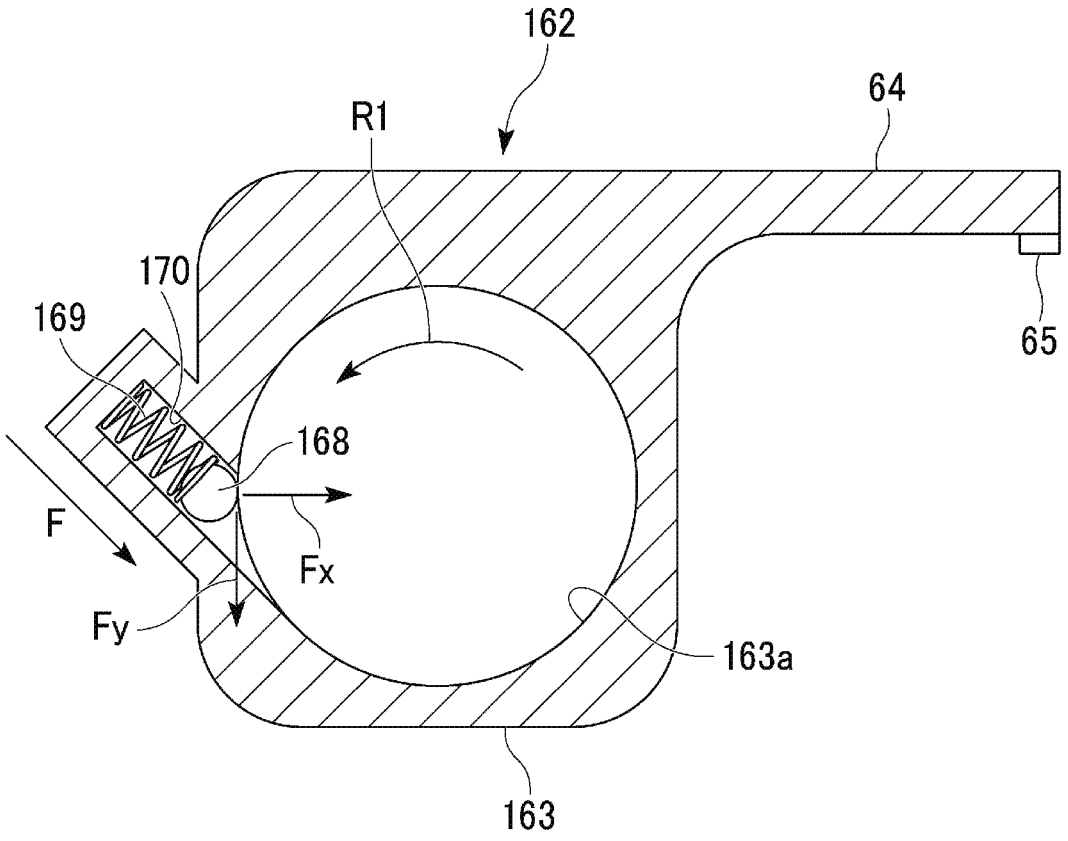
FIG. 14 is a diagram illustrating a structure of the engagement portion according to a modification example.

As illustrated in FIG. 14, an engagement portion 162 which is the modification example includes a base portion 163, the arm portion 64, the engagement protrusion 65, a contactor 168, and an urging body 169. The engagement portion 162 is different from the engagement portion 62 illustrated in FIG. 3 in that the contactor 168 and the urging body 169 are included.

An urging force of the urging body 169 is denoted by "F". "Fx" denotes a diameter direction component of the urging force F and is a force by which the contactor 168 dampens the first rotator 41. "Fy" denotes a component in a tangential direction of the urging force F (a tangential direction at a point at which the contactor 168 comes into contact with the first rotator 41). The point at which the contactor 168 comes into contact with the first rotator 41 is referred to as a "contact point of the contactor 168".

An accommodation hole 170 that accommodates the contactor 168 and the urging body 169 is formed in the inner circumferential surface of an insertion hole 163*a* of the base portion 163. The accommodation hole 170 is sloped in the diameter direction of the insertion hole 163*a* when viewed in a direction parallel to the shaft direction of the insertion hole 163*a* (see FIG. 14). Fy is oriented in the same direction as a tangential direction component of the first direction R1 at the contact point of the contactor 168. A direction in which the accommodation hole 170 is formed (a depth direction) is a direction sloped on the upstream side of the first direction R1 with respect to the diameter direction of the insertion hole 163*a*.

The contactor 168 is a sphere. For example, the contactor 168 is made of a metal such as stainless steel. The contactor 168 comes into contact with the outer circumferential surface of the first rotator 41 to be pressed by the urging force of the urging body 169. When the contactor 168 comes into contact with the outer circumferential surface of the first rotator 41, the engagement portion 162 is easily rotated integrally with the first rotator 41 by friction between the contactor 168 and the first rotator 41.

The contactor 168 is retained to be revolvable between the urging body 169 and the first rotator 41.

For example, the urging body 169 is a coil spring. The urging body 169 is accommodated in the accommodation hole 170. The urging body 169 urges the contactor 168 toward the first rotator 41 with a reactive force on the bottom of the accommodation hole 170. A direction of the urging force by the urging body 169 is parallel to the direction in which the accommodation hole 170 is formed.

Contact resistance of the engagement portion 162 to the first rotator 41 when the first rotator 41 is rotated in the second direction R2 is greater than contact resistance of the engagement 162 to the first rotator 41 when the first rotator 41 is rotated in the first direction R1. Therefore, in the normal working, the contact resistance is relatively small. When the first rotator 41 is rotated in a direction reverse to that of the normal working (the second direction R2), the contact resistance is greater than in the normal working. Accordingly, the engagement portion 162 which is the modification example can suppress abrasion of the engagement portion 162 in the normal working. When the first rotator 41 is rotated in the direction reverse to that of the normal working (the second direction R2) with regard to the engagement portion 162, the engagement portion 162 can reliably be rotated and moved.

When the first rotator 41 is rotated, the contactor 168 comes into contact with the outer circumferential surface of the first rotator 41 to revolve with the rotation of the first rotator 41.

Since the contactor 168 which is a revolvable sphere is used in the engagement portion 162, it is possible to suppress abrasion of the contactor 168 when the first rotator 41 is rotated. When the contactor 168 is made of a metal, the abrasion due to contact with the first rotator 41 can be suppressed.

Second Embodiment

An image forming apparatus according to a second embodiment will be described. The same reference numerals are given to common configurations to those of the first embodiment and the description thereof will be omitted.

Figure 15:
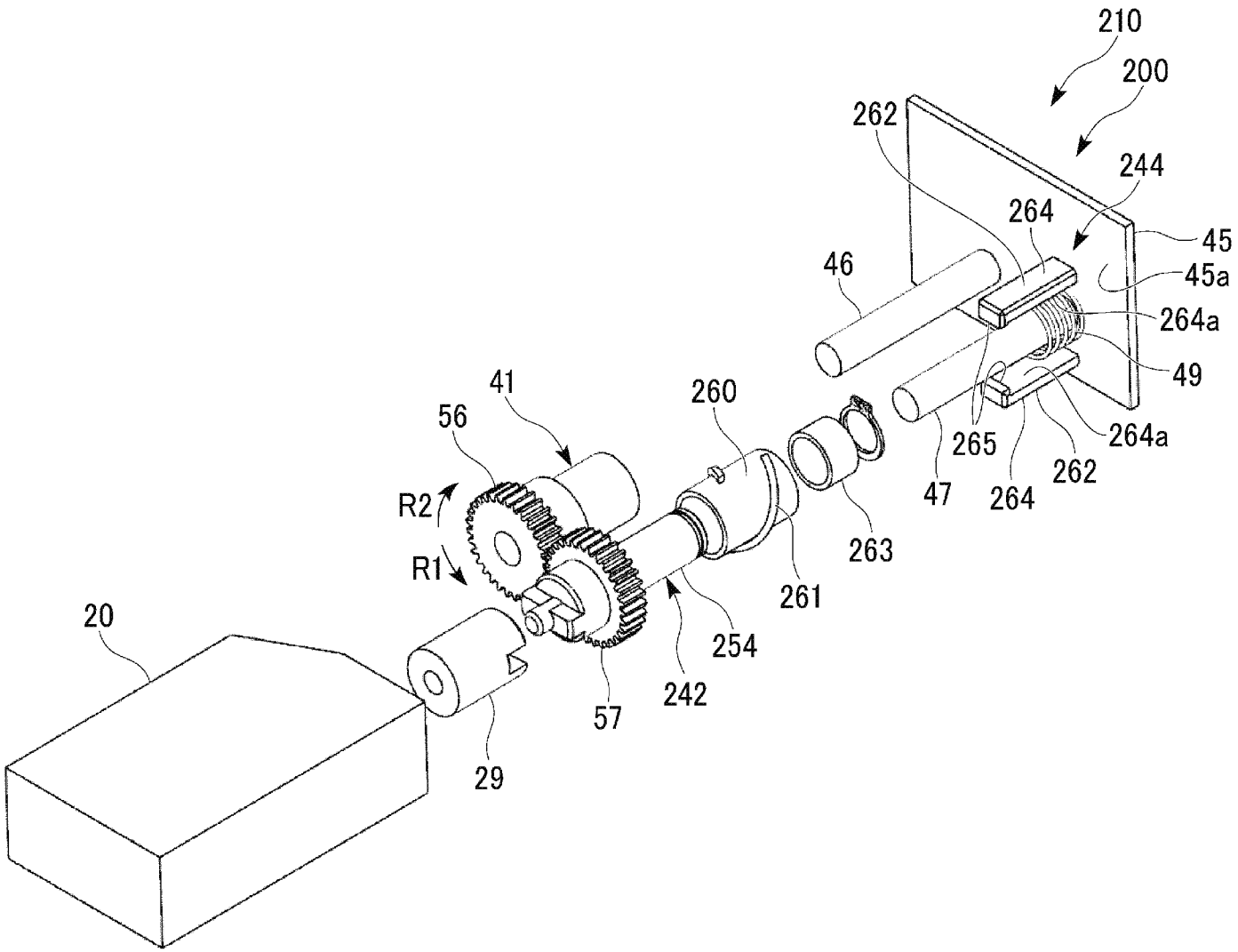
FIG. 15 is an exploded perspective view illustrating a connection mechanism of an image forming apparatus according to a second embodiment.

As illustrated in FIG. 15, a connection mechanism 200 of an image forming apparatus 210 is different from the connection mechanism 100 illustrated in FIG. 2 in that a displacement mechanism 244 is included instead of the displacement mechanism 44.

The displacement mechanism 244 includes an outer tube body 260, a one-way bearing 263 (one-way clutch), and an engagement portion 262.

The one-way bearing 263 is formed in a cylindrical shape. The one-way bearing 263 has a structure for transmitting a rotational force in only one direction. A known structure can be adopted for the one-way bearing 263. A second cylinder portion 254 of the second rotator 242 is inserted through the one-way bearing 263.

The outer tube body 260 is formed in a cylindrical shape. The one-way bearing 263 and the second cylinder portion 254 of the second rotator 242 is inserted through the outer tube body 260. A slope portion 261 is formed on the outer circumferential surface of the outer tube body 260. The slope portion 261 is a convex portion formed in a helical shape about the central shaft of the second rotator 242.

Since the outer tube body 260 is inserted through the one-way bearing 263, the outer tube body 260 operates as follows. The outer tube body 260 is not rotated when the second rotator 242 is driven and rotated with the rotation of the first rotator 41 in the first direction R1. The outer tube body 260 is rotated along with the second rotator 242 when the second rotator 242 is driven and rotated with the rotation of the first rotator 41 in the second direction R2.

The engagement portion 262 includes a pair of arm portions 264 and engagement protrusions 265. The arms 264 protrude from the main surface 45*a* of the base substrate 45 to be vertical to the main surface 45*a*. The arms 264 are formed closely to the second shaft 47. The one pair of arms 264 are formed at positions at which the arms 264 face each other with the second shaft 47 interposed therebetween.

The engagement protrusion 265 is formed in one surface 264*a* of the arm 264. The surface 264*a* is a surface facing the second shaft 47. The engagement protrusion 265 is a convex portion that protrudes to be vertical to the surface 264*a* of the arm portion 264. The engagement protrusion 265 is formed at a position at which the engagement protrusion 265 can engage with the slope portion 261. The engagement protrusion 265 is formed at the distal end of the arm portion 264 in the extension direction.

Next, an operation of the image forming apparatus 210 will be described.

First, an operation in normal working of the image forming apparatus 210 will be described.

Figure 16:
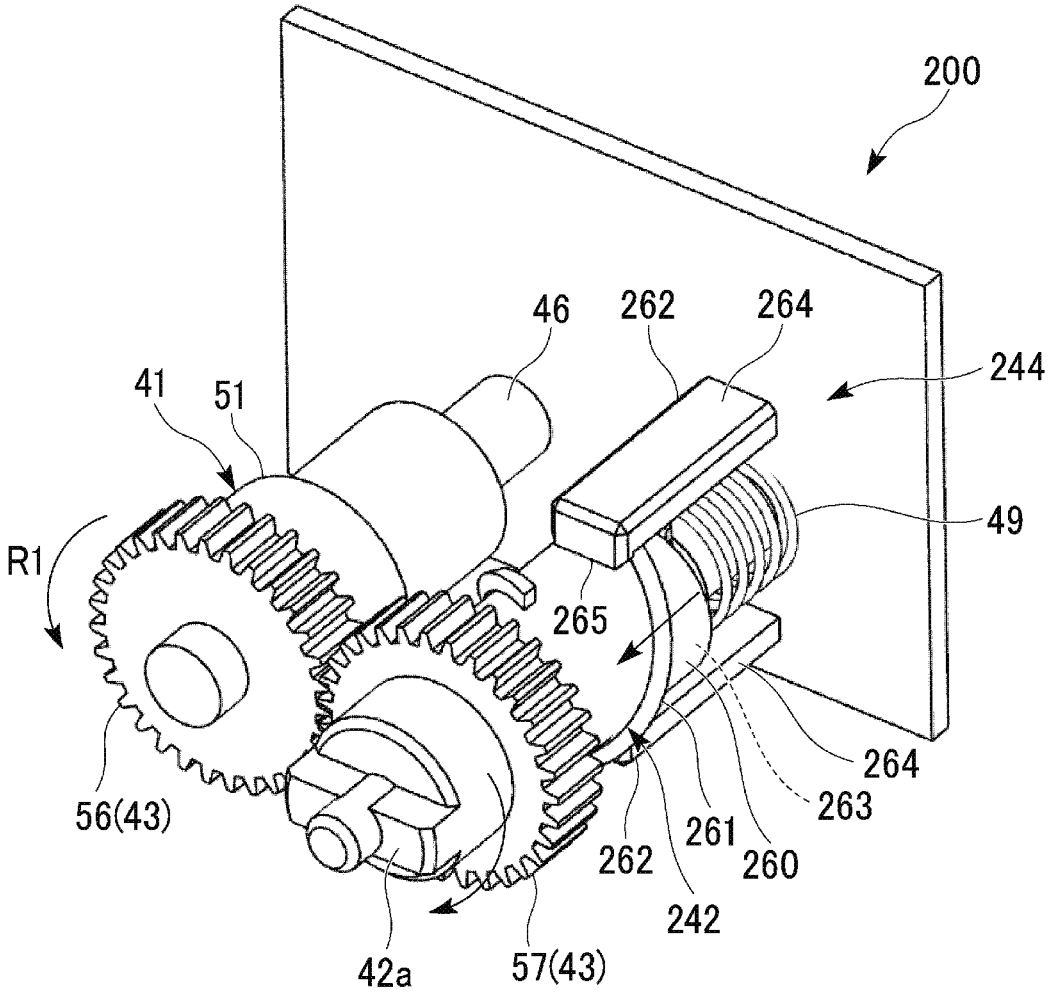
FIG. 16 is a perspective view illustrating the connection mechanism of the image forming apparatus.

As illustrated in FIG. 16, the first rotator 41 is rotated in the first direction R1. The second rotator 242 is driven by the first rotator 41 to be rotated in an arrow direction. A driving force of the second rotator 242 is transmitted to the process unit 20 via the coupling 29 (see FIG. 15).

As described above, the outer tube body 260 is not rotated in accordance with the function of the one-way bearing 263. Since the displacement mechanism 244 does not function, the second rotator 242 maintains the connection state to the process unit 20.

Next, an operation when the process unit 20 is detached for maintenance or the like will be described.

Figure 17:
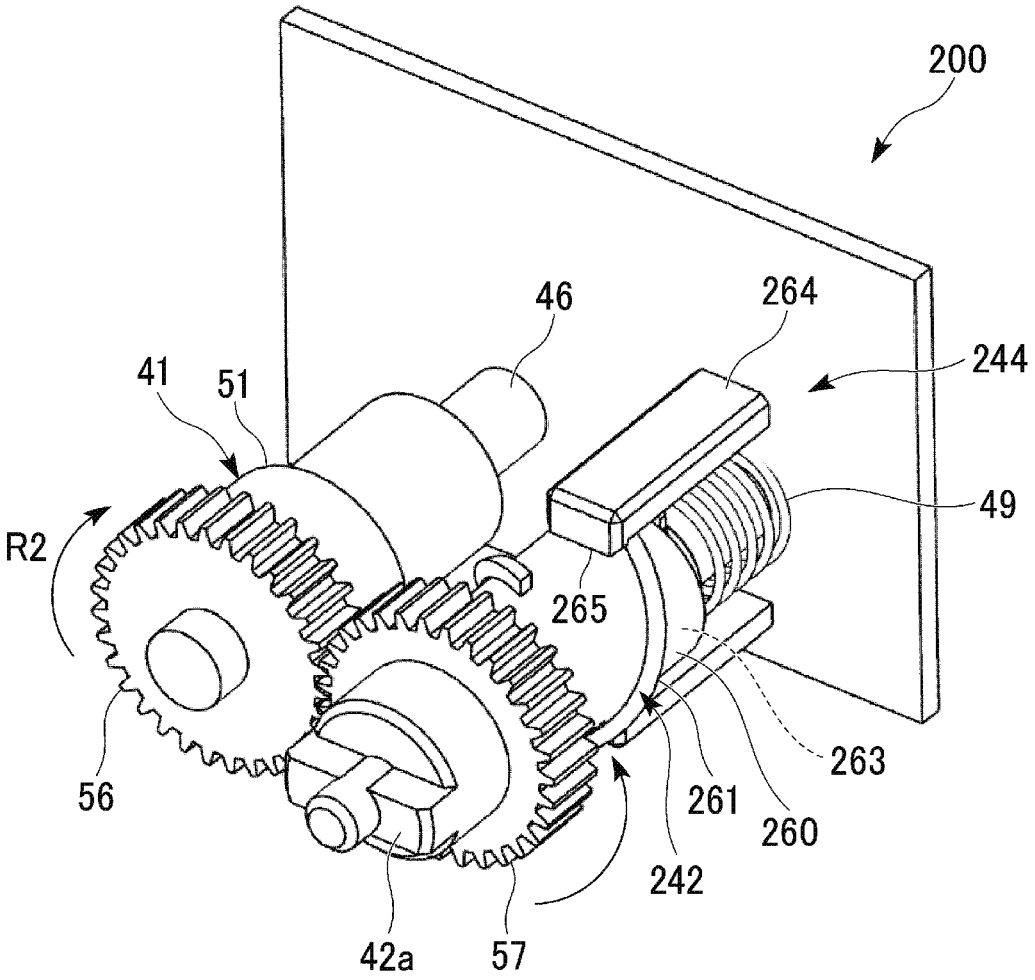
FIG. 17 is a perspective view illustrating the connection mechanism of the image forming apparatus.

As illustrated in FIG. 17, the first rotator 41 is rotated in the second direction R2. The second rotator 242 is driven by the first rotator 41 to be rotated in the arrow direction.

As described above, the outer tube body 260 is rotated along with the second rotator 242 in accordance with the function of the one-way bearing 263.

Figure 18:
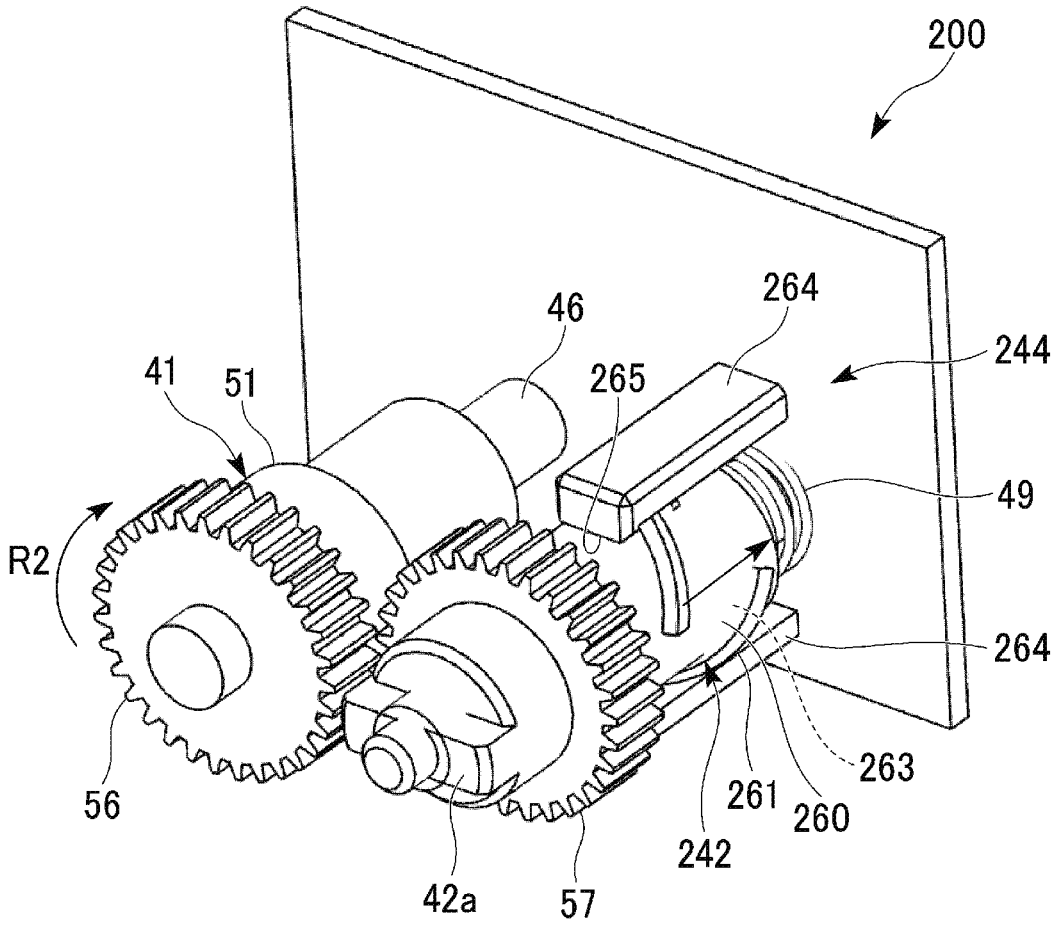
FIG. 18 is a perspective view illustrating the connection mechanism of the image forming apparatus.

When the engagement protrusion 265 engages with the slope portion 261 and the second rotator 242 is rotated in the arrow direction (see FIG. 17), as illustrated in FIG. 18, the second rotator 242 is displaced along the slope of the slope portion 261 in the shaft direction of the second rotator 242 in a direction (backwards) away from the process unit 20 (see FIG. 15). Thus, the second rotator 242 is dislocated from the coupling 29. When the second gear 57 is dislocated from the first gear 56, the second rotator 242 losses the driving force and thus stops.

After the second rotator 242 is dislocated from the coupling 29, the rotation of the first rotator 41 is stopped.

Since the second rotator 242 is dislocated from the coupling 29, the process unit 20 is detached from the image forming apparatus 210 to be supplied for maintenance.

The image forming apparatus 210 includes the displacement mechanism 244 that includes the outer tube body 260. The outer tube body 260 is not rotated when the second rotator 242 is driven and rotated with the rotation of the first rotator 41 in the first direction R1. The outer tube body 260 is rotated along with the second rotator 242 when the second rotator 242 is driven and rotated with the rotation of the first rotator 41 in the second direction R2. Therefore, it is not necessary to mount or separate the engagement portion 262 on or from the second rotator 242. The image forming apparatus 10 can be miniaturized since the connection between the second rotator 42 and the process unit 20 is released by the connection mechanism 100 with a simple configuration.

In the image forming apparatus 10, the fitting protrusion 42*a* is a convex portion and the fitting concave portion 29*a* is a concave portion. However, a structure of the fitting reception portion and the fitting portion is not limited to the illustrated structure as long as the rotational driving force can be transmitted. For example, the fitting reception portion may be a concave portion and the fitting portion may be a convex portion.

The image forming apparatus may be a monochromic image forming apparatus. The number of process units is not limited. The image forming apparatus may include a plurality of printer units.

According to at least one of the above-described embodiments, the displacement mechanism displaces the second rotator in the shaft direction away from the process unit when the first rotator is rotated in the second direction (the reverse direction to that of the normal working). Thus, the connection between the second rotator and the process unit is released. The image forming apparatus can be miniaturized since the connection between the second rotator and the process unit is released by the connection mechanism with a simple configuration.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a process unit configured to form an image;

a first rotator configured to rotate about a first shaft in a first direction and a second direction reverse to the first direction;

a second rotator parallel to the first rotator and detachably connected to the process unit;

a driving force transmission mechanism configured to transmit a driving force of the first rotator to the second rotator to rotate the second rotator about a second shaft when the first rotator is rotated in the first direction; and a displacement mechanism configured to release connection between the second rotator and the process unit by displacing the second rotator in a second shaft direction when the first rotator is rotated in the second direction.

2. The apparatus according to claim 1, wherein the displacement mechanism includes a slope portion extending in a direction sloped in the second shaft direction of the second rotator, and an engagement portion detachably engaging with the slope portion, and when the engagement portion engages with the slope portion and the first rotator is rotated in the second direction, the second rotator is rotated by the driving force transmitted by the driving force transmission mechanism and is displaced in a separation direction from the process unit along the slope of the slope portion.

3. The apparatus according to claim 2, wherein the slope portion is formed in a helical direction about the second shaft of the second rotator.

4. The apparatus according to claim 1, wherein the engagement unit includes a base portion mounted on the first rotator, an arm portion extending from the base portion, and an engagement protrusion provided to the arm portion and detachably engaging with the slope.

5. The apparatus according to claim 4, wherein the engagement portion is rotated in a direction in which the engagement protrusion approaches the second rotator by rotating the first rotator in the second direction.

6. The apparatus according to claim 4, wherein an elastic piece coming into contact with an outer circumferential surface of the first rotator to be pressed is formed in the base portion.

7. The apparatus according to claim 4, wherein the engagement portion further includes a contactor coming into contact with the outer circumferential surface of the first rotator to be pressed and an urging body urging the contactor toward the first rotator.

8. The apparatus according to claim 7, wherein the contactor comprises a metal.

9. The apparatus according to claim 2, wherein the slope portion is formed on an outer circumferential surface of an outer tube body through which the second rotator is inserted, and the outer tube body is not rotated when the second rotator is driven and rotated with the rotation of the first rotator in the first direction, and the outer tube body is rotated along with the second rotator when the second rotator is driven and rotated with the rotation of the first rotator in the second direction.

10. The apparatus according to claim 1, further comprising:

an urging member configured to urge the second rotator toward the process unit.

11. A method associated with an image forming apparatus, comprising:

rotating a first rotator about a first shaft in a first direction and a second direction reverse to the first direction;

transmitting a driving force of the first rotator to a second rotator to rotate the second rotator about a second shaft when the first rotator is rotated in the first direction, the second rotator parallel to the first rotator and detachably connected to a process unit for forming an image; and releasing a connection between the second rotator and the process unit by displacing the second rotator in a second shaft direction when the first rotator is rotated in the second direction.

12. The method according to claim 11, further comprising:

urging the second rotator toward the process unit.

13. An image forming apparatus, comprising:

a process unit configured to form an image;

a first rotator configured to rotate about a first shaft in a first direction and a second direction reverse to the first direction;

a second rotator parallel to the first rotator and detachably connected to the process unit;

a driving force transmission mechanism configured to transmit a driving force of the first rotator to the second rotator to rotate the second rotator about a second shaft when the first rotator is rotated in the first direction, the driving force transmission mechanism comprising two gears; and a displacement mechanism configured to release connection between the second rotator and the process unit by displacing the second rotator in a second shaft direction when the first rotator is rotated in the second direction.

14. The apparatus according to claim 13, wherein the two gears comprise a first gear coupled to the first shaft and a second gear coupled to the second shaft.

15. The apparatus according to claim 13, wherein the displacement mechanism includes a slope portion extending in a direction sloped in the second shaft direction of the second rotator, and an engagement portion detachably engaging with the slope portion, and when the engagement portion engages with the slope portion and the first rotator is rotated in the second direction, the second rotator is rotated by the driving force transmitted by the driving force transmission mechanism and is displaced in a separation direction from the process unit along the slope of the slope portion.

16. The apparatus according to claim 15, wherein the slope portion is formed in a helical direction about the second shaft of the second rotator.

17. The apparatus according to claim 13, wherein the engagement unit includes a base portion mounted on the first rotator, an arm portion extending from the base portion, and an engagement protrusion provided to the arm portion and detachably engaging with the slope.

18. The apparatus according to claim 17, wherein the engagement portion is rotated in a direction in which the engagement protrusion approaches the second rotator by rotating the first rotator in the second direction.

19. The apparatus according to claim 17, wherein an elastic piece coming into contact with an outer circumferential surface of the first rotator to be pressed is formed in the base portion.

20. The apparatus according to claim 17, wherein the engagement portion further includes a contactor coming into contact with the outer circumferential surface of the first rotator to be pressed and an urging body urging the contactor toward the first rotator.

* * * * *